US005089049A

United States Patent [19]

Lischka

[11] Patent Number: 5,089,049

[45] Date of Patent: Feb. 18, 1992

[54] PASSIVATION OF PYROPHORIC METALS

[75] Inventor: Helmut Lischka, Trostberg, Fed. Rep. of Germany

[73] Assignee: SKW Trostbert Aktiengesellshaft, Trostberg, Fed. Rep. of Germany

[21] Appl. No.: 482,793

[22] Filed: Feb. 21, 1990

[30] Foreign Application Priority Data

Mar. 17, 1989 [DE] Fed. Rep. of Germany ..... 3908815

[51] Int. Cl.[5] ..... C23F 11/02

[52] U.S. Cl. ..... 75/328; 75/444; 75/722

[58] Field of Search ..... 75/328, 722, 444

[56] References Cited

U.S. PATENT DOCUMENTS 4,329,168 5/1982 Rubio ..... 75/711

4,814,007 3/1989 Lin ..... 75/722

*Primary Examiner*—Peter D. Rosenberg

[57] ABSTRACT

The present invention provides a process for the passivation of pyrophoric metals and especially of magnesium by coating with a passivation agent, wherein, as passivation agent, there is used 0.5 to 5% by weight of an s-triazine derivative and/or a guanidine, referred to the weight of the metal.

The present invention also provides a passivated pyrophoric metal, wherein the metal particles are coated with 0.5 to 5% by weight of an s-triazine derivative and/or guanidine or a guanidine derivative, referred to the weight of the metal.

21 Claims, No Drawings

PASSIVATION OF PYROPHORIC METALS

The present invention is concerned with a process for the passivation of pyrophoric metals, especially of magnesium, and with passivated pyrophoric metals.

It is known that pyrophoric metals, such as magnesium and calcium and alloys of these metals, give rise to particular problems in the handling thereof, especially when these pyrophoric materials are used in finely-divided form.

Thus, for example, magnesium powder which is blown in pneumatically alone or in combination with calcium carbide or lime into molten pig iron with the help of a fire-resistant lance for the purpose of desulphurization cannot be used without problems because of the ready inflammability and the vigour of the burning behaviour. On the contrary, it must first be passivated by means of appropriate agents or methods.

Various suggestions for solving this problem are already known, all of which, however, have not proved to be completely satisfactory.

Thus, according to U.S. Pat. Specifications Nos. 4,209,325 and 3,998,625, it is recommended to dilute magnesium powder with inert oxidic powders, for example lime, aluminium oxide, silicon dioxide dusts or metallurgical slags. These metal oxides, which are usually admixed in amounts of 10 to 50% by weight with the magnesium metal powder, do not participate in the desulphurization reaction and, therefore, bring about only a poor degree of action of the desulphurization agent. Problems also arise due to the demixing of the various components of the mixture.

Therefore, instead of mixing with an inert metal oxide, there has already been described a coating with a metal oxide, for example zirconium dioxide, titanium dioxide or aluminium oxide. However, the problem of easy inflammability is only inadequately solved in this way.

Furthermore, it is known to coat pyrophoric magnesium powder with a layer of salt in which case, as salts, alkali metal and/or alkaline earth metal chlorides have been preponderantly described (see U.S. Pat. Specifications Nos. 3,881,913, 4,186,000 and 4,279,641). Disadvantageous in the case of these suggestions for the solution of the problem are the laborious methods for the production of these salt coatings (see European Patent Specifications Nos. A-0,058,322 and A-0,108,464), as well as the hygroscopic character of these salts. Furthermore, in the case of the metallurgical use of these coated magnesium particles, chlorine-containing waste gases can very easily arise, which make necessary special measures for the protection of the environment.

Therefore, it is an object of the present invention to provide a process for the passivation of pyrophoric metals and especially of magnesium by coating with a passivation agent which does not display the mentioned disadvantages of the prior art but rather, without great technical expense, provides the pyrophoric metals with a coating which effectively suppresses the ready inflammability of these metals and, at the same time, does not give rise to any environmental problems.

Thus, according to the present invention, there is provided a process for the passivation of pyrophoric metals and especially of magnesium by coating with a passivation agent, wherein, as passivation agent, there is used 0.5 to 5% by weight of an s-triazine derivative and/or a guanidine, referred to the weight of the metal.

Surprisingly, we have found that, according to the process of the present invention, with comparatively small amounts of passivation agent, a very strong suppression of the inflammability, as well as a positive influencing of the burning behavior, can be achieved.

In the case of the process according to the present invention, the pyrophoric metal, which can be especially magnesium, calcium or an alloy of these metals, is coated with a passivation agent based upon s-triazine and/or guanidine derivatives. For the purpose according to the present invention, it is completely sufficient when the passivation agent is employed in an amount of from 0.5 to 5% by weight and preferably of from 1 to 3% by weight, referred to the weight of the metal. In principle, it is possible also to use larger amounts but this excess very quickly becomes uneconomical because it does not provide any additional beneficial effects.

As passivation agents, there can, in the scope of the present invention, be used all s-triazine and/or guanidine derivatives.

Of s-triazine derivatives, melamine is especially preferred because of its economically favourable availability. Also readily available and usable without problems and, therefore, preferred, are the s-triazine derivatives ammeline and ammelide and the guanamines benzoguanamine and acetoguanamine. For the purpose according to the present invention, there can also be used compounds which contain several s-triazine structural units. These include polymeric s-triazines and higher condensed s-triazine compounds, for example melam, melem and melon. Finally, it is also possible to use condensation products of s-triazines, for example of melamine and/or of benzoguanamine, condensation products with formaldehyde thereby being preferred.

From the guanidine group of compounds, there can, in principle, be used a large number of compounds in which case, as guanidines, there can be used not only unsubstituted guanidine itself but also substituted guanidines, possibly in the form of salts. As a rule, use will be made of guanidines which are relatively simple to produce and thus are economically available. In the case of the substituted guanidines, this applies especially to cyanoguanidine (dicyandiamide), as well as to guanylurea and guanylurea phosphate, for which reason these compounds are preferably used.

In addition, simple guanidine salts can also be used, the anions of which do not contain any disturbing components, for example chlorides. Preferred are guanidine phosphates, guanidine sulphamates and guanidine cyanurates, which are also readily available.

In order to achieve a good adhesion of the passivation agent to the pyrophoric metal, a wetting agent is preferably added thereto which is advantageously anhydrous and is used in an amount of from 0.1 to 0.5% by weight, referred to the weight of the metal. As anhydrous wetting agents, there can be employed conventional products, in which case the use of highly viscous oils, especially silicone oils and/or mineral oils, has proved to be especially advantageous.

The production of the coating on the pyrophoric metals can be carried out without problems and in a technically simple manner. For example, a finely-divided passivation agent, for example in the form of a powder, is first sprayed, possibly in an inert gas atmosphere, with the wetting agent and subsequently the passivation agent is applied to the surface of the pyrophoric metals by using conventional methods, e.g. mixing.

The passivation agents must be present in a form which is as finely-divided as possible in order to ensure a complete coating and satisfactory adhesion. Therefore, the passivation agents are preferably used with a particle size of <50 μm. and preferably of <10 μm.

In this way, satisfactorily adhering coatings can be produced which can also be stored for a comparatively long period of time without problems.

Furthermore, the passivated metals produced by the process according to the present invention are characterised by a low inflammability, as well as by a favourable burning behaviour. Therefore, they are suitable to an especial degree as treatment agents for metallurgical melts and preferably for the desulphurization of pig iron since, in the case of thermal decomposition of the passivation agent, no undesired or disturbing decomposition products arise.

The following Examples are given for the purpose of illustrating the present invention:

EXAMPLE 1

97 Parts by weight of metallic magnesium powder (magnesium content 99.8%) with a grain size of 0.2 to 0.8 mm. were first mixed with 0.3 parts by weight of a silicone oil (Wacker AK 100). The components were intensively mixed with one another until a complete wetting of the magnesium particles had been achieved. Subsequently, 3 parts by weight of finely-divided cyanoguanidine (particle size 98% <10 μm) were added thereto and the passivation layer formed by intensive mixing with the magnesium powder.

EXAMPLE 2

According to Example 1, 99 parts by weight of metallic magnesium powder (magnesium content 99.8%) with a grain size of 0.2 to 0.8 mm. were coated with part by weight of finely-divided cyanoguanidine (particle size 98% <10 μm.).

EXAMPLE 3

According to Example 1, 97 parts by weight of metallic magnesium powder (magnesium content 99.8%) with a grain size of 0.2 to 0.8 mm. were passivated with parts by weight of finely-divided melamine (particle size 99% <60 μm.).

EXAMPLE 4

INVESTIGATION OF THE BURNING AND IGNITION BEHAVIOR

For the assessment of the passivation effect, there was carried out a burning test recommended by the BAM (Bundesanstalt for Materialprufung) for the classification of readily inflammable solid materials in the dangerous material classes.

In the case of this test, the test substance is formed in a commercially available mould into an uninterrupted packing of about 250 mm. length, 20 mm. breadth and 10 mm. height and placed on a cold, impermeable substrate with low thermal conductivity. The packing is ignited on one end with the help of a Bunsen burner. The observed combustion time is a measure of the pyrophoric character of the test substance.

In the following Table are summarised the results of the burning and ignition experiments. There were tested not only pure non-passivated magnesium powder (1) and coatings with the oxidic substances according to the prior art (2) to (4) but also magnesium passivated according to the present invention (5) to (7).

Whereas oxidic passivation agents (2) to (4) bring about only slight improvements in comparison with pure magnesium powder, the products according to the present invention show a surprisingly strong passivation action.

An addition of only 3% by weight of cyanoguanidine to the magnesium powder is sufficient to make the product non-inflammable. Only with difficulty could it be ignited with a Bunsen burner flame and subsequently extinguished itself. A smaller added amount of 1% by weight of cyanoguanidine is still sufficient to retard the speed of burning of the pure magnesium powder by a factor of 4.

TABLE

Burning and ignition experiments

| Experiment | Composition | | burning away time for 200 mm · measured length |
|---|---|---|---|
| 1 comparison | 100% by wt. Mg | 99.8% | 8 minutes |
| 2 comparison | 88% by wt. Mg alloy<br>12% by wt. coating | 90%<br>10% by wt. $Al_2O_3$<br>2% by wt. $SiO_2$ | 10 minutes |
| 3 comparison | 73% by wt. Mg alloy<br>15% by wt. Al powder<br>12% by wt. coating | 90%<br>10% by wt. $Al_2O_3$<br>2% by wt. $SiO_2$ | 7 minutes |
| 4 comparison | 50% by wt. Mg<br>50% by wt. ball mill dust | 99.8%<br>35% by wt. $Al_2O_3$<br>13.5% by wt. Al<br>1.5% by wt. NaCl + KCl | 11 minutes |
| 5 | 97% by wt. Mg<br>3% by wt. cyanoguanidine | 99.8% | extinguishes after ignition |
| 6 | 99% by wt. Mg<br>1% by wt. cyanoguanidine | 99.8% | 27 minutes |
| 7 | 97% by wt. Mg<br>3% by wt. melamine | 99.8% | 32 minutes |

I claim:

1. Process for the passivation of the pyrophoric metals magnesium, calcium and alloys of these metals by coating with a passivation agent, wherein there is used 0.5 to 5% by weight of a passivation agent selected from the group consisting of an s-triazine derivative and a guanidine, referred to the weight of the metal.

2. Process according to claim 1, wherein the passivation agent is used in an amount of from 1 to 3% by weight, referred to the weight of the metal.

3. Process according to claim 1, wherein melamine is used as s-triazine derivative.

4. Process according to claim 1, wherein the s-triazine derivative is selected from the group consisting of benzoguanamine and acetoguanamine.

5. Process according to claim 1, wherein the s-triazine derivative is selected from the group consisting of melam, melem and melon.

6. Process according to claim 1, wherein the s-triazine derivative is selected from the group consisting of a melamine- and a benzoguanamine-formaldehyde condensation product.

7. Process according to claim 1, wherein at least one substituted guanidine is used as guanidine.

8. Process according to claim 7, wherein the substituted guanidine is selected from the group consisting of cyanoguanidine and guanylurea.

9. Process according to claim 7, wherein a guanidine salt selected from the group consisting of guanidine phosphate, guanidine sulphamate and guanidine cyanurate is used as guanidine derivative.

10. Process according to claim 1, wherein the coating of the metal with the passivation agent is carried out with the help of an anhydrous wetting agent.

11. Process according to claim 10, wherein the wetting agent is used in an amount of from 0.1 to 0.5% by weight, referred to the weight of the metal.

12. Process according to claim 10, wherein a silicone oil is used as wetting agent.

13. Pyrophoric metals, wherever passivated by the process according to claim 1.

14. Passivated pyrophoric metal, wherein the metal particles are coated with 0.5 to 5% by weight of an s-triazine derivative and/or guanidine or a guanidine derivative, referred to the weight of the metal.

15. Passivated pyrophoric magnesium according to claim 14.

16. Passivated metal according to claim 14, wherein it contains 1 to 3% by weight of the coating agent.

17. Passivated pyrophoric metal according to claim 14, wherein the coating agent contains at least one substance selected from the group consisting of melamine, benzoguanamide, acetoguanamine, melam, melem, melon, melamine-formaldehyde condensate, benzoguanamine condensate, guanidine, cyanoguanidine, guanylurea, guanidine phosphate, guanidine sulphamate and guanidine cyanurate.

18. Passivated pyrophoric metal according to claim 13, wherein it additionally contains 0.1 to 0.5% by weight of wetting agent.

19. Passivated pyrophoric metal according to claim 14, wherein the coating of s-triazine derivative and/or guanidine or guanidine derivative consists of particles with a size of $<50\ \mu m$.

20. Passivated pyrophoric metal according to claim 14, substantially as hereinbefore described and exemplified.

21. The use of a passivated pyrophoric metal according to claim 13, as a treatment agent for metallurgical melts.

* * * * *